US011628642B2

(12) United States Patent
Espe

(10) Patent No.: US 11,628,642 B2
(45) Date of Patent: Apr. 18, 2023

(54) METHOD FOR PRODUCING A PRESS PAD

(71) Applicant: HUECK Rheinische GmbH, Viersen (DE)

(72) Inventor: Rolf Espe, Bochum (DE)

(73) Assignee: HUECK Rheinische GmbH, Viersen (DE)

( * ) Notice: Subject to any disclaimer, the term of this patent is extended or adjusted under 35 U.S.C. 154(b) by 442 days.

(21) Appl. No.: 16/724,828

(22) Filed: Dec. 23, 2019

(65) Prior Publication Data

US 2020/0171772 A1 Jun. 4, 2020

Related U.S. Application Data

(63) Continuation of application No. PCT/EP2018/068633, filed on Jul. 10, 2018.

(30) Foreign Application Priority Data

Jul. 11, 2017 (DE) ..... 202017003635.5

(51) Int. Cl.

| | |
|---|---|
| ***D03D 15/00*** | (2021.01) |
| ***D02G 3/44*** | (2006.01) |
| ***D02G 3/04*** | (2006.01) |
| ***B30B 15/06*** | (2006.01) |
| ***D02G 3/02*** | (2006.01) |
| ***D02G 3/36*** | (2006.01) |
| ***D03D 15/47*** | (2021.01) |

(52) U.S. Cl.

CPC ..... *B30B 15/061* (2013.01); *D02G 3/02* (2013.01); *D02G 3/36* (2013.01); *D02G 3/443* (2013.01); *D03D 15/47* (2021.01)

(58) Field of Classification Search

None

See application file for complete search history.

(56) References Cited

U.S. PATENT DOCUMENTS 5,075,038 A * 12/1991 Cole ..... C08K 3/08 252/514

2001/0029139 A1* 10/2001 Espe ..... D03D 15/00 442/182

FOREIGN PATENT DOCUMENTS

| | | | |
|---|---|---|---|
| EP | 1136248 | A1 | 9/2001 |
| EP | 1300235 | A1 | 4/2003 |
| EP | 2002973 | A1 | 12/2008 |
| FR | 1260273 | A | 5/1961 |
| JP | H06322326 | A | 11/1994 |
| WO | WO2007129041 | | 11/2007 |

* cited by examiner

*Primary Examiner* — Shawn Mckinnon

(74) *Attorney, Agent, or Firm* — Von Rohrscheidt Patents

(57) ABSTRACT

A thread made from extruded silicone rubber that is cross-linked after the extrusion and woven into a fabric having warp threads and/or weft threads and a coating including cross-linked silicone rubber, the thread or the coating including a fluorinated rubber portion. The invention also relates to a method for producing such threads and woven fabrics. The object of the invention is to improve thermal and chemical resistance. To this end the fluorinated rubber part is produced only by surface fluorination of the cross-linked thread or the coating by means of a fluorinated gas.

16 Claims, No Drawings

METHOD FOR PRODUCING A PRESS PAD

RELATED APPLICATIONS

This application is a continuation of International application PCT/EP2018/068633 filed on Jul. 10, 2018, claiming priority from German patent application DE 20 2017 003 635.5 filed on Jul. 11, 2017, both of which are incorporated in their entirety by this reference.

FIELD OF THE INVENTION

The invention relates to two methods for producing a press pad, wherein a thread is produced from a high temperature resistant elastomeric matrix with an additive for increasing heat conductivity, a fabric with warp threads and/or weft threads is produced from the thread and the press pad is produced from the fabric or the high temperature resistant elastomeric matrix with the additive is coated onto a fabric with weft threads and/or warp threads and subsequently crosslinked.

BACKGROUND OF THE INVENTION

Press pads of this type are used as pressure compensation fabrics in hydraulic presses when coating wood material plates like plywood, particle board, MDF or HDF plates with paper webs that are infused with synthetic resin. The coating is mostly performed in single level presses with fast closing speeds and short pressing times, so-called short cycled presses, at temperatures of 200 to 230 degrees C., and pressing pressures of 40 to 60 kg/cm$^2$. During coating water and formaldehyde vapor are released. Only high temperature resistant materials like silicone rubber, fluor silicone rubber and fluor rubber and their blends and copolymers are being used.

In order to produce press pads of this type, EP 1 136 248 A1 and EP 1 300 235 A1 propose to introduce a metal powder, in particular copper, aluminum or aluminum bronze, or also carbon, in particular graphite or ferro silicone powder as a heat conducting additive into the elastomeric material matrix before crosslinking. Due to the high viscosity of the elastomeric matrix of the known press pads, powdery additives can only be introduced with some difficulty, in particular by kneading. Therefore, the additives are distributed in the end product unevenly. Furthermore, the Shore hardness of the elastomeric matrix increases enormously, which degrades the reset capabilities of the press pad and causes the elastomeric matrix to become brittle during use.

BRIEF SUMMARY OF THE INVENTION

Thus, it is an object of the invention to evenly distribute the additive in the press pad.

Improving upon the known method, it is proposed according to the invention that the additive is dispersed in an organically modified siloxane and introduced into the elastomeric matrix by the organically modified siloxane.

Advantageously, the thread includes a stabilizing core thread according to a first method according to the invention. This increases tensile strength of the thread. Further advantageously, the core thread is made from metal. This further improves heat conduction of the press pad. Using metal core threads is known, e.g., from EP 1 136 248 A1.

Advantageously, the elastomeric matrix is made according to the invention from a silicone rubber, a fluor silicone rubber, a fluor rubber or a copolymer made from silicone rubber and fluor silicone rubber. The recited materials are high temperature resistant. Using the materials as an elastomeric matrix is known, e.g., from EP 1 136 248 A1.

Advantageously, the organically modified siloxane has a comb or block structure that is modified relative to a polydimethylsiloxane according to the method according to the invention, wherein additional methyl groups are advantageously substituted by acrylic, epoxy, phenyl, hydroxyl, amino, carboxyl or alkyl groups. Organically modified siloxanes of this type are known, e.g. from Lehmann K., et al., Heat transfer and flame retardant properties of silicone elastomers, International Polymer Science and Technology January 2017, Smithers Rapra, Akron/OH, USA 2017.

Organically modified polysiloxanes with comb or block structure can be dispersed much better, in particular with heat conductive additives, than the known materials of the elastomeric material matrix. The selection of the organically modified siloxanes with comb or block structure can be different depending on the application, wherein the organic substituent groups provide the desired properties. It is advantageous to select organically modified polydimethylsiloxanes which have good dispersing properties so that the heat conductive pigments can be distributed evenly.

Advantageously, the introduced portion amounts to 10% to 95% by weight of the fabric or a portion of the additive is between 10% and 95% of the introduced portion. These portions facilitate achieving useful results depending on the application.

Advantageously, the additive has a specific heat conductivity of at least 1 W/mK in a method according to the invention. In a high temperature resistant elastomeric matrix with a heat conductivity under 0.2 W/mK, useful results can be achieved with these additives.

Advantageously, the additive is made from silicone oxide, aluminum oxide, calcium carbonate, hexagonal boron nitrite, a carbon modification like graphite, soot or carbon fibers, pure metal powder like copper, silver or aluminum, or a nanoscale material, in particular single-wall or multi-wall carbon nanotubes according to a method according to the invention.

Different heat conductivity values are found in mineral filling materials. Thus, values from 4 to 30 W/mK were found in mineral filling materials like $SiO_2$, $Al_2O_3$, and $CaCO_3$. Hexagonal boron nitride (hbN) also has very high heat conductivity values like the carbon modifications graphite, soot and carbon fibers. The distribution of pure metal powders like copper, silver and aluminum in the organically modified polysiloxanes is quite varied and a high concentration is not advantageous since resetting properties of the elastomeric threads can be degraded. Furthermore, particular metals can react with each other chemically, in particular when peroxides are used as crosslinkers. This causes exothermal reactions and premature crosslinking during subsequent processing in an extruder. Thus, the transport helix and the nozzles can be damaged.

Experimental analysis on single or multiple wall carbon nanotubes indicate enormously high heat conductivity values of these nanoparticles. Thus, a heat conductivity of more than 3,000 W/mK was measured at a single multiwall carbon nanotube at room temperature so that a theoretical value of 6,600 W/mK was computed for an isolated single walled carbon nanotube. This has the effect that small amounts of carbon nanotube additives in a polymer can significantly increase the heat conductivity in the entire elastomeric material compound. Thus, a heat conductivity at room temperature of 0.6 W/mK was found in an elastomeric material matrix with a content of 50% by weight of an organically modified polydimethylsiloxane with a dispersed additive of 30% by weight BN and 5% by weight of multiple wall carbon nanotubes (MWKM) and at a content of 7.5% by weight MWKN even a value of over 0.8 W/mK was achieved, wherein the unmodified elastomeric matrix had a heat conductivity of 0.24 W/mK.

Advantageously, the additive is surface treated in a method according to the invention, in particular with silanes or silane based compounds. Thus, heat conductivity of the elastomeric materials is utilized in an optimum manner.

Various additives are commercially available and they are surface treated with silanes or silane based compounds in order to provide optimum compatibility at a boundary surface between the polymer matrix and at the filler material. Silanes are bifunctional compounds that are made from stable, organofunctional and hydrolizable reactive end groups. The hydrolizable group connects to the surface of the filling material while the organofunctional groups harmonize with the polymer. Thus, it also has become evident that coated filling materials can be worked into a polyorganosiloxane more easily than uncoated filling materials.

Advantageously, the threads of the press pad are configured with different elastomeric material mixes and additives in a method according to the invention. A press pad according to the invention has zones with different heat conductivity. A press pad according to the invention can thus be individually adapted to the parameters of the press arrangement, in particular to an uneven temperature distribution in the press arrangement, and can thus be adapted to the requirements of the production process.

DETAILED DESCRIPTION OF THE INVENTION

The invention is subsequently described based on an advantageous embodiments. A first elastomeric material mix is made from 45% by weight silicone elastomeric material HTV with vinyl groups non crosslinked with the catalyst component Di-(2.4 dichlorbenzoyl)peroxide and 55% by weight organically modified siloxane type Tegosil HT2100 with filling material $Al_2O_3$.

A second elastomeric material mix is made from 50% by weight silicone elastomeric materials HTV with 5% by weight fluor silicone elastomeric material non-crosslinked with catalyst component Di (2.4 dichlorobenzoyl)peroxide and 50% by weight organically modified polysiloxane with organic polymers on an acrylate base that are arranged along the chain with 30% by weight hBN and 5% by weight MWKN dispersed therein.

After tempering at approximately 200 degrees C., the first elastomeric material mix has a heat conductivity of 0.4 W/mK and a Shore hardness of 55 and the second elastomeric mix has a heat conductivity of 0.75 W/mK and a hardness of 60. The two elastomeric material mixes have a significantly increased heat conductivity compared to silicone elastomeric material HTV without modification (0.24 W/mK, Shore hardness 68), whereas the shore hardness had a reduced value which is advantageous for the reset properties of the press pads.

From the elastomeric matrix materials a thread a thread was produced, then a fabric with warp threads and weft threads was produced from the thread and eventually a press pad was produced from the fabric. Measurements at the press pads have shown that heat conductivity is doubled or tripled.

What is claimed is:

1. A method for producing a press pad, the method comprising the steps:

providing an elastomeric material matrix that is resistant to temperatures above 200 degrees C. and that includes an additive that increases heat conductivity;

producing a thread from the elastomeric material matrix;

producing a fabric with warp threads and weft threads from the thread;

producing the press pad from the fabric, wherein the additive is dispersed in an organically modified siloxane and worked into the elastomeric material matrix together with the organically modified siloxane, and wherein the organically modified siloxane is organically modified polysiloxane with organic polymers on an acrylate base that are arranged along the chain with 30% by weight hexagonal boron nitride and 5% by weight multiwall carbon nanotubes dispersed therein.

2. The method according to claim 1, wherein the thread includes a stabilizing core thread.

3. The method according to claim 2, wherein the core thread is made from metal.

4. A method for producing a press pad, the method comprising the steps:

coating an elastomeric material matrix that is resistant to temperatures above 200 degrees C. and that includes an additive that increases heat conductivity onto a fabric that includes warp threads weft threads; and crosslinking the high temperature resistant elastomeric material matrix after the coating, wherein the additive is dispersed in an organically modified siloxane and worked into the high temperature resistant elastomeric material matrix together with the organically modified siloxane, and wherein the organically modified siloxane is organically modified polysiloxane with organic polymers on an acrylate base that are arranged along the chain with 30% by weight hexagonal boron nitride and 5% by weight multiwall carbon nanotubes dispersed therein.

5. The method according to claim 1, wherein the high temperature resistant elastomeric material matrix is made from a silicone rubber, a fluor silicone rubber, a fluor rubber or a copolymer that includes silicone rubber and fluor silicone rubber.

6. The method according to claim 1, wherein the organically modified siloxane has a comb or block structure that is modified relative to a polydimethylsiloxane, wherein methyl groups are substituted by acrylate, epoxy, phenyl, hydroxyl, amino, carboxyl or alky groups.

7. The method according to claim 1, wherein the worked in portion is between 10 and 95% by weight of the fabric and/or a portion of the additive is between 10 and 95% by weight of the worked in portion.

8. The method according to claim 1, wherein the additive has a specific heat conductivity of at least 1 W/mK.

9. The method according to claim 1, wherein the additive is made from silicone oxide, aluminum oxide, calcium carbonate, hexagonal boron nitride, a carbon modification, graphite, soot, carbon fibers, pure metal powder, copper, silver aluminum or from a nanoscale material that includes single wall or multiple carbon nanotubes.

10. The method according to claim 1, wherein the additive is surface treated with silanes or silane-based compounds.

11. The method according to claim 4, wherein the high temperature resistant elastomeric material matrix is made from a silicone rubber, a fluor silicone rubber, a fluor rubber or a copolymer that includes silicone rubber and fluor silicone rubber.

12. The method according to claim 4, wherein the organically modified siloxane has a comb or block structure that is modified relative to a polydimethylsiloxane, wherein methyl groups are substituted by acrylate, epoxy, phenyl, hydroxyl, amino, carboxyl or alkyl groups.

13. The method according to claim 4, wherein the worked in portion is between 10 and 95% by weight of the fabric and/or a portion of the additive is between 10 and 95% by weight of the worked in portion.

14. The method according to claim 4, wherein the additive has a specific heat conductivity of at least 1 W/mK.

15. The method according to claim 4, wherein the additive is made from silicone oxide, aluminum oxide, calcium carbonate, hexagonal boron nitride, a carbon modification, graphite, soot, carbon fibers, pure metal powder, copper, silver aluminum or from a nanoscale material that includes single wall or multiple carbon nanotubes.

16. The method according to claim 4, wherein the additive is surface treated with silanes or silane-based compounds.

* * * * *